US005820139A

United States Patent [19]

Grindl

[11] Patent Number: 5,820,139

[45] Date of Patent: Oct. 13, 1998

[54] SNOW BOARD BINDING

[76] Inventor: Steve Grindl, 853 Beacon St., Newton, Mass. 02159

[21] Appl. No.: 648,361

[22] Filed: May 14, 1996

[51] Int. Cl.[6] ..... A63C 9/00

[52] U.S. Cl. ..... 280/14.2; 280/618; 280/623

[58] Field of Search ..... 280/607, 618, 280/620, 617, 623, 630, 634, 142; 441/70

[56] References Cited

U.S. PATENT DOCUMENTS

| | | | |
|---|---|---|---|
| 3,135,525 | 6/1964 | Powers | 280/620 |
| 5,028,068 | 7/1991 | Donovan | 280/618 |
| 5,277,635 | 1/1994 | Gillis | 280/14.2 |
| 5,499,837 | 3/1996 | Hale et al. | 280/607 |
| 5,553,883 | 9/1996 | Erb | 280/14.2 |
| 5,577,755 | 11/1996 | Metzger et al. | 280/607 |
| 5,586,779 | 12/1996 | Dawes et al. | 280/607 |

*Primary Examiner*—Brian L. Johnson
*Assistant Examiner*—Min Yu
*Attorney, Agent, or Firm*—John P. McGonagle

[57] ABSTRACT

A snow board binding with an attached base, which comes between the rider's foot and the snow board, that may be mounted to a snow board. The binding base features a pivoting mechanism comprised of a spinning disk, a locking lever, a tension wire, and two static bolts, i.e., a first static bolt and a second static bolt. The spinning disk, located in the center of the binding base, contains four holes by which the binding is fastened to the snow board. The outer edge of the disk contains a groove large enough to accept the tension wire. The lever is located at the outer edge of the binding, held fast by the first static bolt. The tension wire, extended from the fastened edge of the lever, arcs around the spinning disk, terminating at and fastened to the second static bolt. When engaged, the lever pulls on the wire, tightening tension. This creates a heightened friction between the wire and disk, thereby preventing the disk from spinning. When the lever is disengaged, the rider may freely rotate the binding and his foot up to 360°.

6 Claims, 6 Drawing Sheets

SNOW BOARD BINDING

BACKGROUND OF THE INVENTION

This invention relates to snow boards, and in particular to a coupling for releasably connecting a user boot binding to a snow board.

A snow board rider uses a boot designed especially to the requirements of snow boarding. As with skiing, it is required to secure the boot to the snow board with a binding. However, snow boarding differs from skiing in that both user boots attach to a single snow board, and the user does not employ poles. Also, unlike skiing, the boot bindings are mounted to the snow board with screws into a pattern of screw holes, possible threaded inserts in the snow board. This pattern of screw holes or inserts typically allows adjustment in stance relative to the longitudinal center line of the snow board and stance width. The stance angle is varied with user preference and the style of snow boarding intended. Stance width is selected by the user on the basis of personal comfort and leg length. Typically, changing the stance angle means releasing the boot from its binding and loosening the mounting screws so that the binding may be rotated, and then retightening the screws. Changing the stance width means removing the screws entirely and selecting another pattern of screw holes or inserts in the snow board.

When using commercial ski area lifts, a snow board user is required to disengage at least one boot from a boot binding to maneuver onto the chair because he is generally immobile with both legs attached to a single board, no ski poles, and no downward sloping terrain in his intended direction of travel. With one leg disengaged, he pushes himself forward with his free leg. This maneuvering with one leg attached to the snow board and the other free is referred to as "skate boarding." This forward movement is very difficult because the attached leg is still held at an angle that is conducive to riding the board downhill, but is in a very awkward angle for skate boarding.

Having mounted the chair with only one boot attached to the board, the user is again challenged to dismount from the chair in full motion with a single boot engaged in an awkward angle, usually down a slight incline. A toughened surface is usually provided on the snow board for temporary control during dismounting; the user places the unbound boot on the roughened surface which then allows limited control until he stops to rebind the boot to the boot binding.

SUMMARY OF THE INVENTION

In view of the foregoing problems associated with snow boarding, the present invention provides a snow board binding with an attached base, which comes between the rider's foot and the snow board, that may be mounted to a snow board. The present invention provides the capability of changing the relative angle between the binding and the snow board without tools or the snow board rider having to remove his foot from the binding or detach the binding from the snow board.

To attain this capability, the present invention provides a binding base which features a pivoting mechanism comprised of a spinning disk, a locking lever, a tension wire, and two static bolts, i.e., a first static bolt and a second static bolt. The spinning disk, located in the center of the binding base, contains four holes by which the binding is fastened to the snow board. The outer edge of the disk contains a groove large enough to accept the tension wire. The lever is located at the outer edge of the binding, held fast by the first static bolt. The tension wire, extended from the fastened edge of the lever, arcs around the spinning disk, terminating at and fastened to the second static bolt. When engaged, the lever pulls on the wire, tightening tension. This creates a heightened friction between the wire and disk, thereby preventing the disk from spinning. When the lever is disengaged, the rider may freely rotate his foot 360°.

The main objective of the present invention is to provide a snow board rider with the ability to change his stance angle without the aid of tools and without the need of removing his boot from the binding. The action of the present invention binding enables the snow board rider to fine tune his stance angle at anytime. In addition, the snow board rider's ability to quickly change the angle of his binding will allow a "skate boarding" rider to more easily traverse flat land since the rider's bound foot can be pointing forward.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF THE INVENTION

Figure 1:
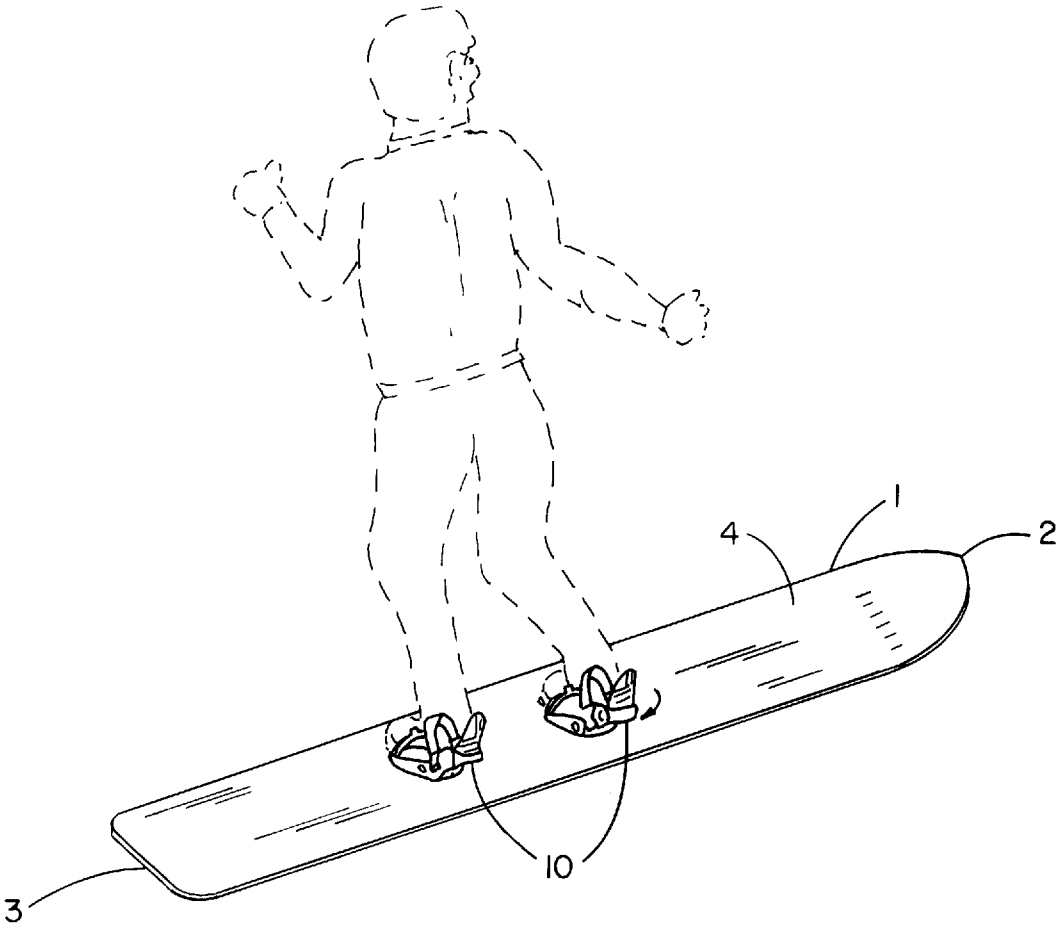
FIG. 1 is a perspective view of a snow board with a rider.
Figure 2:
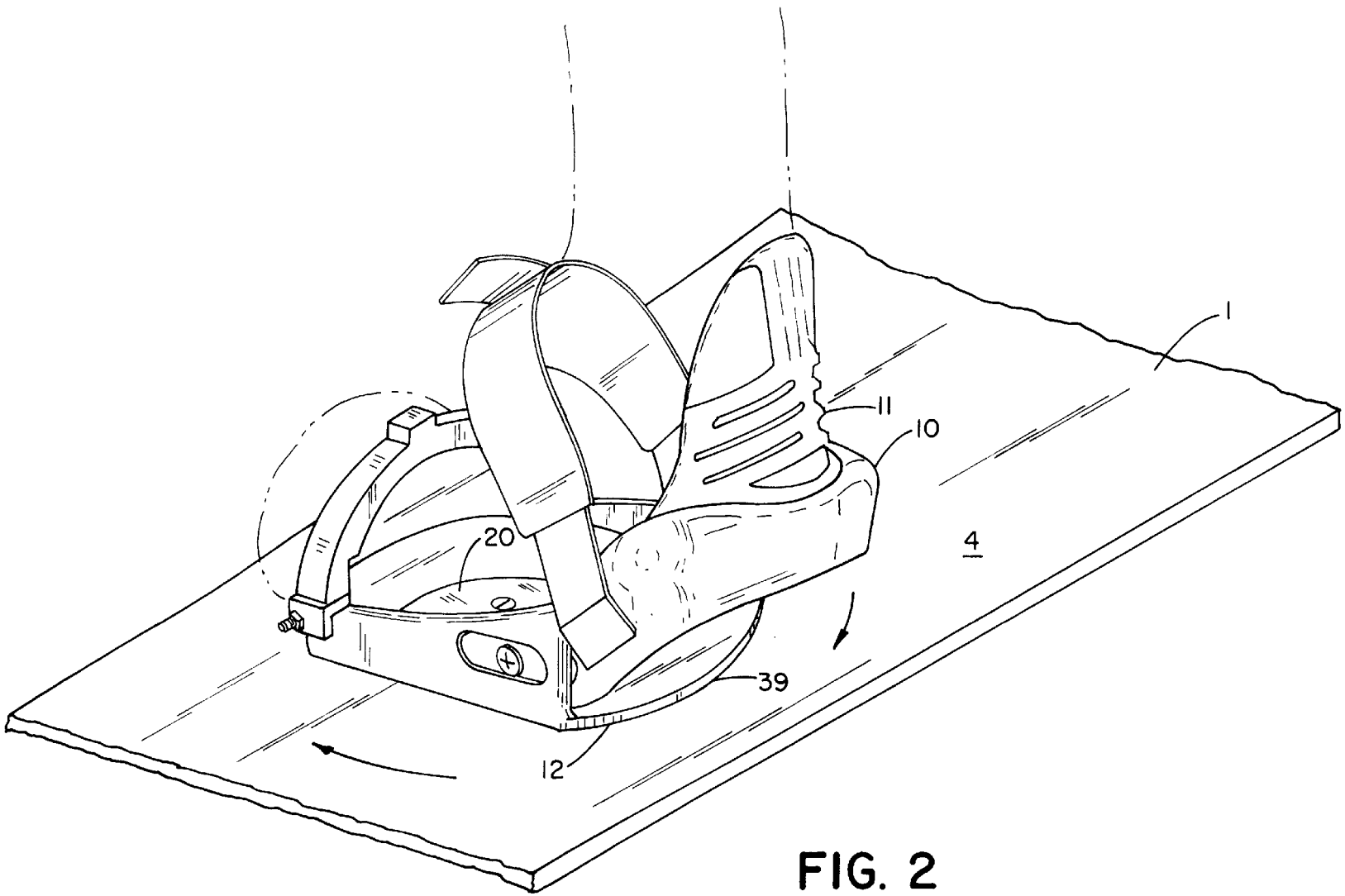
FIG. 2 is a close-up view of the instant invention binding attached to a snow board.
Figure 3:
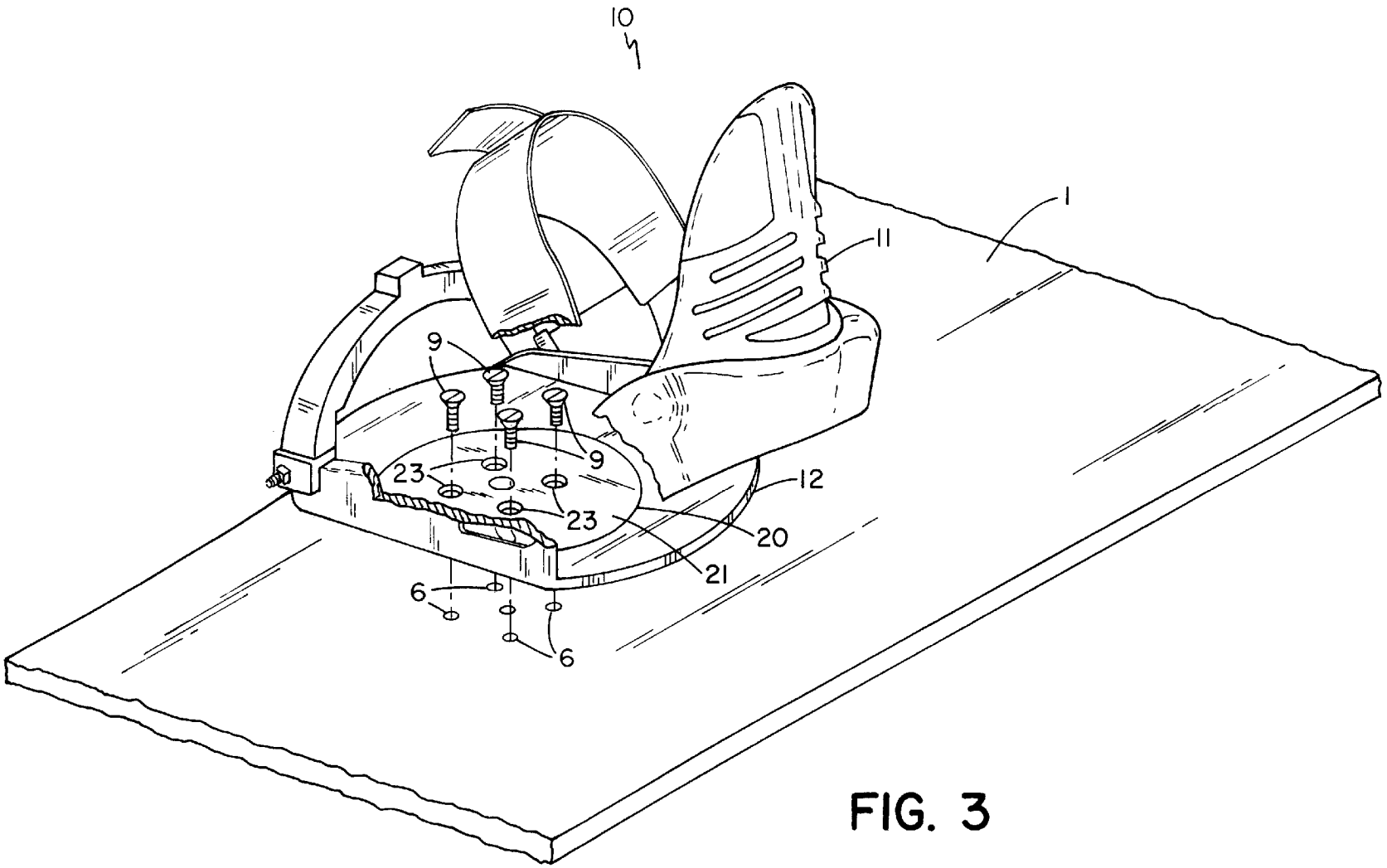
FIG. 3 is a partially sectional and exploded view of the binding shown in FIG. 2.
Figure 4:
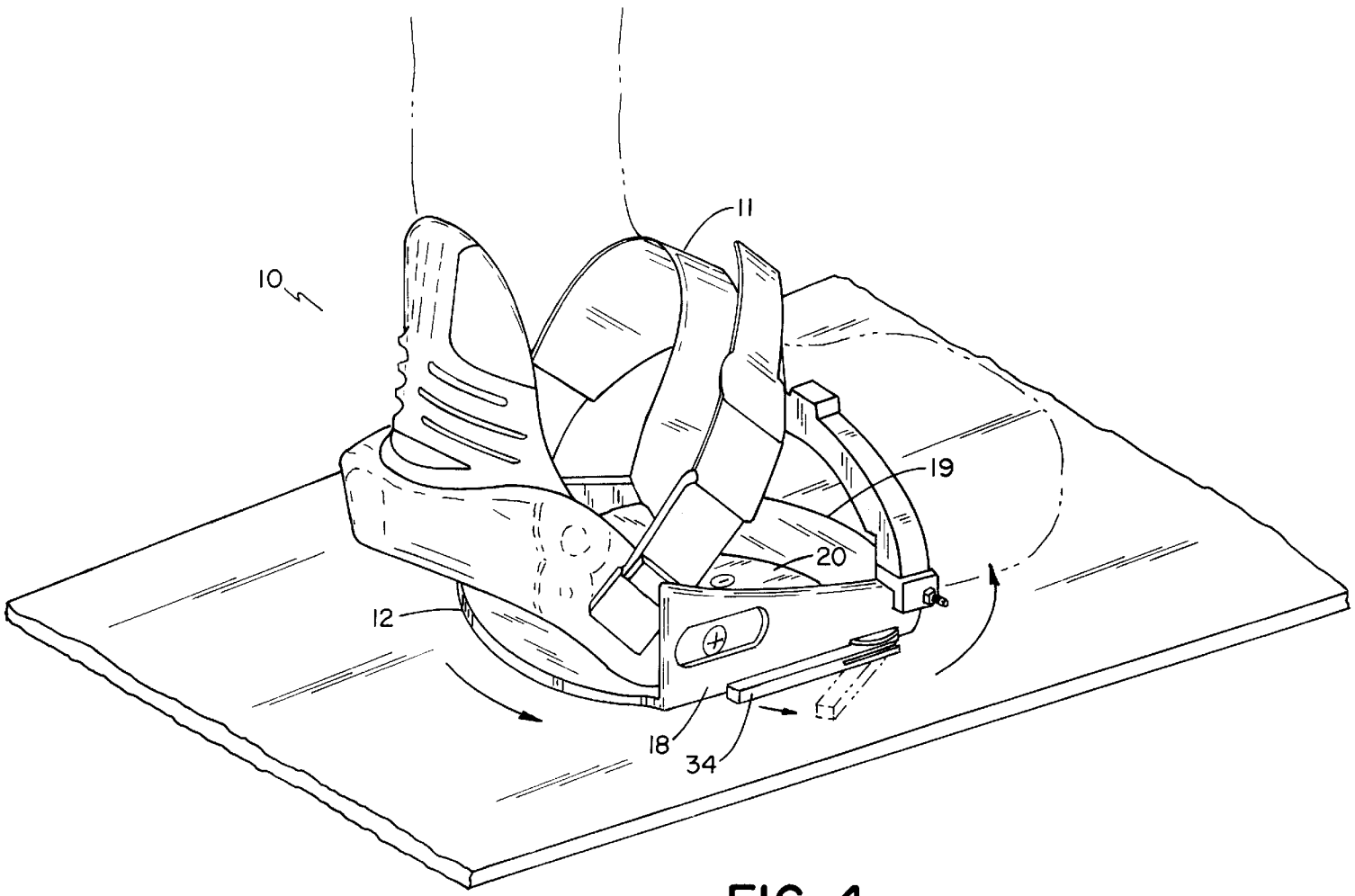
FIG. 4 illustrates the binding of FIG. 2 with locking lever visible.
Figure 5B:
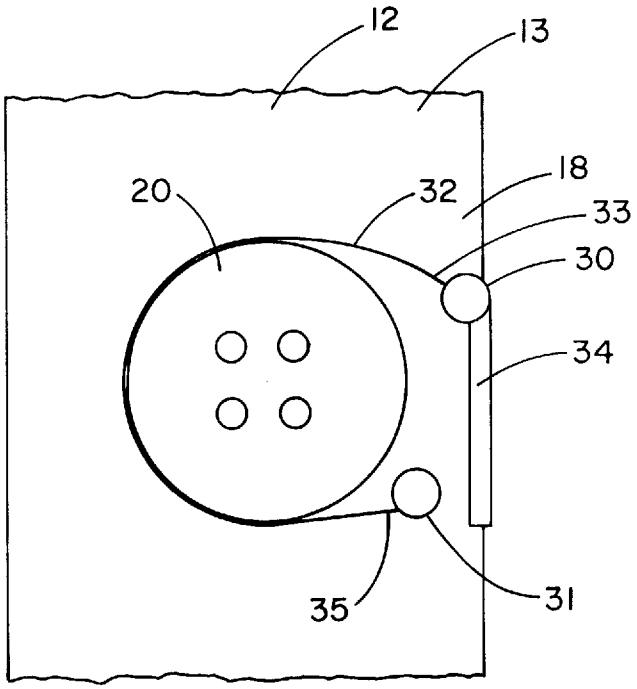
FIG. 5B is a top diagrammic view of the instant invention binding with locking lever engaged.
Figure 5A:
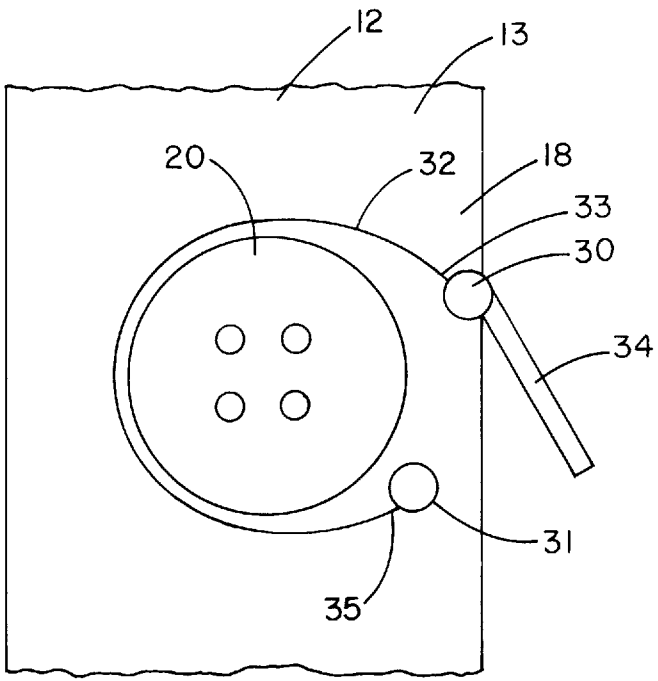
FIG. 5A is a top diagrammic view of the instant invention binding with locking lever released.

Referring to the drawings in detail wherein like elements are indicated by like numerals, there is shown a snow board binding 10 constructed according to the principles of the present invention. The binding 10 is attached to a snow board 1. The snow board 1 has a front end 2, rear end 3, upper surface 4 and lower surface 5. The upper surface 4 has a pattern of four holes 6 formed therein. Snow board manufacturers have adopted a system, termed the 4×4 Pattern, which is comprised of two rows of holes drilled into a snow board, said rows being 40 mm apart (measured on center), said holes within said rows also being 40 mm apart (measured on center). Bindings with a disk system using the 4×4 Pattern have four holes drilled into a hold-down plate, thereby allowing riders to change their stance angle relative to their board without drilling additional holes. The pattern of the holes in the hold-down plate matches the holes in a snow board. When a rider wants to change his stance angle, he must remove his boot from the binding and then loosen the four bolts holding the binding to the board.

The binding 10 of the instant invention has a foot engaging portion 11 attached to a flat base 12. The base 12 has an upper surface 13 to which the foot engaging portion 11 is attached, an under surface 14 which rests on the snow board upper surface 4, a forward end 19, a rearward end 39 and two sides 18. The base 12 has a central, circular opening 15 formed therein. The perimeter 16 of said opening 15 has a channel 17 formed therein opening onto the base upper surface 13. The base 12 is attached to the snow board 1 by means of a disk 20 inserted into said base central opening 15 and fixedly attached to said snow board 1.

The disk 20 has an upper surface 21, a lower surface 22 and an outer edge 26. The disk 20 also has four holes 23 formed therein from the upper surface 21 through to the lower surface 22. The holes 23 are in a 4×4 pattern corresponding to the usual 4×4 pattern of snow board manufacturers. Other hole patterns in the disk 20 could be used to correspond to other patterns for other snow board manufacturers. The disk upper surface perimeter 24 terminates in a flange 25 with dimensions corresponding to the dimensions of the binding base, central opening, perimeter channel 17. The disk 20 is positioned within said binding base opening 15 so that the disk lower surface 22 rests on said snow board upper surface 4, and said disk upper surface flange 25 engages said binding base opening perimeter channel 17. The disk 20 is attached to said snow board 1 by fasteners 9, usually threaded, inserted into said disk holes 23 from the disk upper surface 21, through the disk lower surface 22 and into corresponding snow board holes 6.

Figure 6A:
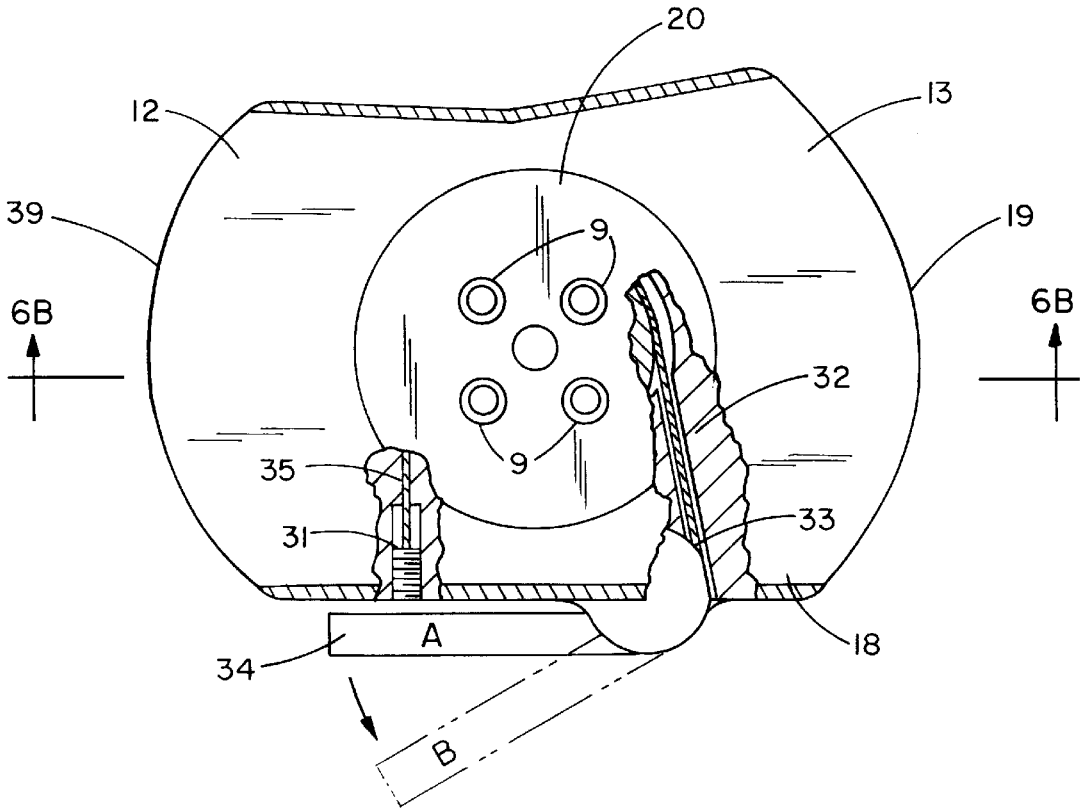
FIG. 6A is a top view, partly in section, of the instant invention binding.
Figure 6B:
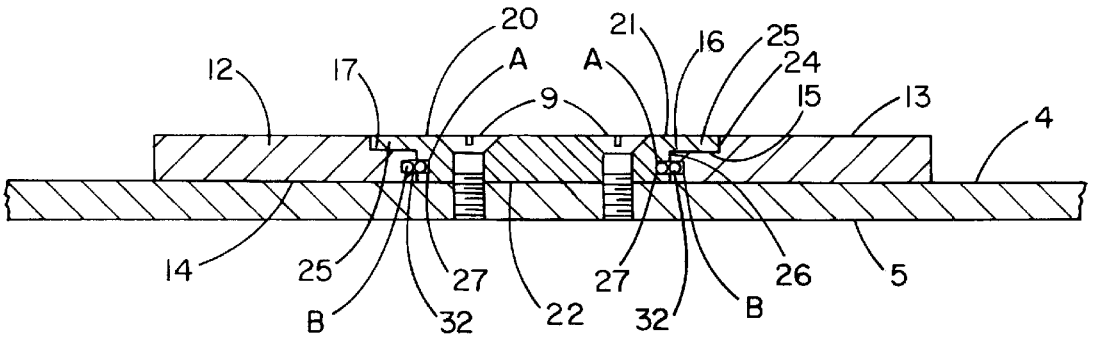
FIG. 6B is a side cross-sectional view of the instant invention binding along the line 6B—6B of FIG. 6A.

The binding base 12 has two static bolts 30, 31 fixedly attached thereto along one side 18. The outer edge 26 of the disk 20 contains a continuous groove 27 about the perimeter of the entire outer edge 26. A tension wire 32 is fitted into said disk groove 27. One end 33 of the tension wire 32 terminates in a lever 34 pivotally attached to the foremost or first static bolt 30. The tension wire 32 extends from the fastened edge of the lever 33 and arcs around the disk 20, within the groove 27. The other end 35 of the tension wire 32 threadingly engages the rearmost or second static bolt 31. When engaged, the lever 34 pulls on the tension wire 32, tightening the tension. See FIGS. 6A and 6B, and the lever 34 in position A. This tightens the wire 32 around the disk groove 27 and creates increased friction between the wire 32 and disk 20, thereby preventing the binding base 12 from turning about the disk 20. When the lever 34 is released, the wire 32 around the disk groove 27 is loosened and the binding base 12 may be freely rotated 360°. See FIGS. 6A and 6B, and the lever 34 in position B. Thus, a snow board rider may change the relative angle between the binding 10 and the snow board 1 without removing his foot from the binding 10, nor detaching the binding 10 from the snow board 1. Simple manipulation of the lever 34 releases the binding 10 to freely rotate to a desired relative angle. Upon reaching the desired relative angle, engagement of the lever 34 locks the binding 10 into place. Fine tension adjustment of the wire 32 is provided by the threading engagement of the non-levered wire end 35 with the rearmost static bolt 31.

It is understood that the above-described embodiment is merely illustrative of the application. Other embodiments may be readily devised by those skilled in the art which will embody the principles of the invention and fall within the spirit and scope thereof.

I claim:

1. A snow board binding attached to a snow board, said snow board having a front end, a rear end, an upper surface and a lower surface, said snow board upper surface having a plurality of holes formed therein, comprising:

a foot engaging portion;

a flat base having an upper surface to which the foot engaging portion is attached, an under surface which rests on the snow board upper surface, a forward end, a rearward end, and two sides, said base having a central, circular opening formed therein from the upper surface through to the lower surface;

a disk inserted into said base central opening and fixedly attached to said snow board, said disk having an upper surface, a lower surface and an outer edge, said disk having a plurality of holes formed therein from the upper surface through to the lower surface;

a plurality of fasteners attaching said disk to said snow board, said fasteners being inserted into said disk holes from the disk upper surface, through the disk lower surface and into corresponding snow board holes;

a first and second static bolt fixedly attached to the base along one side;

a lever pivotally attached to the first static bolt, said lever having an open position and a closed position;

a tension wire fitted about said disk outer edge, said tension wire having two ends, one of said ends fixedly attached to said lever, said tension wire extending from said lever and arcing around said disk, wherein the other end of the tension wire engages the second static bolt;

wherein said lever is adapted to pull on the wire when in the closed position thereby tightening tension on said wire and creating a heightened friction between the wire and disk, thereby preventing the binding base from rotating around said disk;

wherein said lever is adapted to loosen tension on the wire when in the open position thereby allowing the binding base to freely rotate up to 360°.

2. A snow board binding as recited in claim 1, wherein:

said binding central opening has a perimeter with a channel formed therein opening onto the base upper surface.

3. A snow board binding as recited in claim 2, wherein:

said disk upper surface has a perimeter terminating in a flange with a radial dimension corresponding to the radial dimension of the binding base central opening perimeter channel, wherein said disk is positioned within said binding base opening so that the disk lower surface rests on said snow board upper surface, and said disk upper surface flange engages said binding base opening perimeter channel.

4. A snow board binding as recited in claim 3, wherein:

said disk outer edge has a continuous groove formed therein.

5. A snow board binding as recited in claim 4, wherein:

said tension wire arcs around said disk within said disk outer edge groove.

6. A snow board binding as recited in claim 5, wherein:

the other end of the tension wire threadingly engages the second static bolt thereby providing fine tension adjustment of the tension wire.

* * * * *